US005145397A

United States Patent [19]

Yamada et al.

[11] Patent Number: 5,145,397

[45] Date of Patent: Sep. 8, 1992

[54] BOARD TO BOARD ELECTRICAL CONNECTOR WITH HEIGHT ADJUSTMENT

[75] Inventors: Tomoo Yamada; Yoshihisa Yamamoto, both of Yokohama; Masanori Yagi, Sagamihara, all of Japan

[73] Assignee: Molex Incorporated, Lisle, Ill.

[21] Appl. No.: 845,880

[22] Filed: Mar. 3, 1992

Related U.S. Application Data

[63] Continuation of Ser. No. 667,723, Mar. 11, 1991, abandoned.

[30] Foreign Application Priority Data

Mar. 14, 1990 [JP] Japan ..... 2-26084

[51] Int. Cl.[5] ..... H01R 13/62

[52] U.S. Cl. ..... 439/328; 439/377

[58] Field of Search ..... 439/152, 153, 155, 157, 439/159, 160, 326, 327, 328, 374, 377

[56] References Cited

U.S. PATENT DOCUMENTS

| | | | |
|---|---|---|---|
| 3,216,580 | 11/1965 | Fricker, Jr. | 439/328 |
| 4,008,942 | 2/1977 | Grossi | 439/328 |
| 4,080,031 | 3/1978 | Sawford-Atkins | 339/65 |
| 4,509,810 | 4/1985 | Erlam et al. | 439/377 |
| 4,917,624 | 4/1990 | Yu | 439/328 |
| 4,995,825 | 2/1991 | Korsunsky et al. | 439/328 |

*Primary Examiner*—David L. Pirlot
*Attorney, Agent, or Firm*—Charles S. Cohen

[57] ABSTRACT

An improved board-to-board electrical connector includes opposite guide posts whose height can be reduced before the connector is placed into an automated soldering apparatus for soldering the connector terminals to selected conductors of a printed circuit board. Each guide post includes an upper and a lower section and the height adjustment of the guide posts is effected by pivotally mounting the upper sections of the guide posts such that they can be rotated into a vertical or horizontal position.

3 Claims, 4 Drawing Sheets

BOARD TO BOARD ELECTRICAL CONNECTOR WITH HEIGHT ADJUSTMENT

This is a continuation of copending application Ser. No. 07/667,723, filed on Mar. 11, 1991, now abandoned.

FIELD OF THE INVENTION

The present invention relates to electrical connectors, and more particularly an electrical connector for establishing electrical connections between two printed circuit boards, and more particularly between selected conductors of one board and selected conductors of the other board.

BACKGROUND OF INVENTION

It is well known in the art that circuit elements such as resistors or integrated circuits may be connected to a printed circuit board by inserting lead wires extending from such circuit elements in selected through holes of the printed circuit board and by soldering the lead wires to the circuit pattern on the boards. Recently developed surface mount technology enables circuit elements to be attached directly to circuits located on a surface of a printed circuit board.

Specifically, circuit elements are arranged with their lead wires located on selected portions of the circuit pattern of a printed circuit board, and solder is applied to the lead wires of circuit elements. The printed circuit board is then passed through an automated soldering apparatus which solders the circuit elements to selected portions of the circuit pattern. Usually a plurality of printed boards each bearing a plurality of circuit elements will be carried one after another into the automated soldering apparatus by conveyor belt.

Integrated circuits, resistors, capacitors and other circuit elements to be located on printed circuit boards are of relatively small size. Consequently, the inlet opening to the automated soldering apparatus is designed to be of a relatively low height.

Accordingly, there is a need to reduce the size of electrical connectors which are mounted on these boards. Connectors used in connecting printed circuit boards have increased in size with the increase in size of the printed circuit boards having circuit patterns of increased density. Such a board-to-board electrical connector is designed to be integrally connected to one board and accommodate the other board in the space defined by two guide posts integrally connected to the opposite sides of the connector housing. These guide posts must be tall enough to apply an adequate force and support to hold firmly a printed circuit board when it is inserted between the opposite guide posts.

Generally, these guide posts are of such height that they cannot pass through the automated soldering apparatus because the guide posts are too tall to pass through the inlet of the automated soldering apparatus.

SUMMARY OF INVENTION

It is an object of the present invention to provide a board-to-board electrical connector which allows a printed circuit board having such an electrical connector mounted thereon to pass through an automated soldering apparatus for soldering the terminals of the electrical connector and/or a plurality of circuit elements to selected locations of the circuit pattern.

To attain this object an electrical connector is provided comprising a connector housing having guide posts integrally connected to its opposite ends and a plurality of terminals arranged at regular intervals in two lines in the connector body housing. The connector housing is adapted to be mounted on a printed circuit board with the terminals soldered to selected conductors on the printed circuit board. The guide posts are adapted to accommodate and hold a printed circuit board and establish electrical connections between the two printed circuit boards. Each of the guide posts includes lower and upper sections with height adjustment means to permit adjustment of the height of each of the guide post. The height adjustment means may comprise means to permit the upper guide post section to rotate 90 degrees with respect to the lower guide post section. The height adjustment means may also comprise means to permit the upper guide post section to be inserted into and pulled out from the lower post section.

With this arrangement, a board-to-board electrical connector mounted on a printed circuit board can reduce the height of its guide posts by rotation or removal of the upper sections of the opposite guide posts, thereby permitting the printed circuit board and electrical connector combination to enter the inlet of an automated soldering apparatus for soldering the terminals of the electrical connector and/or a plurality of circuit elements to selected locations of the circuit pattern.

Other objects and advantages of the present invention will be understood from the following description of the embodiments of the present invention, which are shown in accompanying drawings:

BRIEF DESCRIPTION OF THE DRAWINGS

FIG. 1 is top view of the electrical connector;

FIG. 2 is front view of the electrical connector;

FIG. 3 is a section taken along the line 3—3 in FIG. 1;

FIG. 4 is an enlarged front view of the right guide post in FIG. 1;

FIG. 5 is a left side view of the upper section of the guide post;

FIG. 6 is a right side view of the upper section of the guide post; and

FIG. 7 is a top view of the upper section of the guide post.

FIG. 8 is an enlarged front view of the right guide post in FIG. 8;

FIG. 9 is a left side view of the upper section of the guide post;

FIG. 10 is a top view of the lower section of the guide post;

FIG. 11 is a longitudinal section of the lower section of the guide post; and FIG. 12 is a front view of the upper section of the guide post when pulled up from the lower section of the guide post.

DETAILED DESCRIPTION

Figure 1:
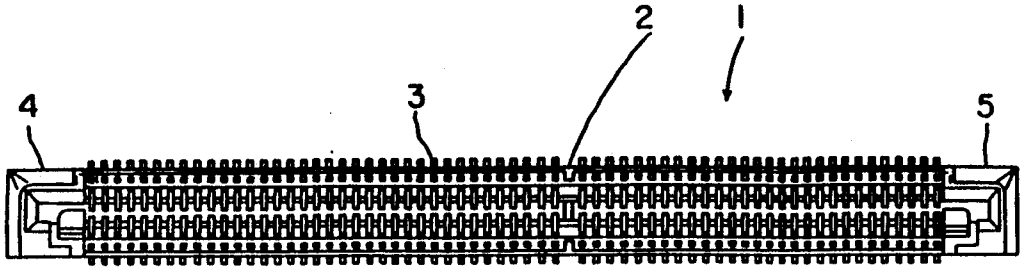
FIGS. 1 to 7 show a board-to-board electrical connector according to a first embodiment of the present invention.

Referring to FIGS. 1 to 7, there is shown a board to board electrical connector according to a first embodiment of the present invention. The electrical connector is indicated generally by and the connector housing is indicated by 2. Vertical guide posts 4 and 5 are integrally connected to the opposite ends of connector housing 2. A plurality of terminals 3 are arranged at regular intervals in two lines in connector housing 2. Connector housing 2 is adapted to be attached to a printed circuit board 6 with its terminals 3 soldered to selected conductors (not shown) on the printed circuit board 6. Each guide post has a peg 8 integrally connected to its lower end. Electrical connector 1 may be mounted on the printed board 6 by inserting pegs 8 of guide posts 4 and 5 in openings (not shown) in the printed circuit board 6 and by soldering these pegs 8 to the board 6.

Figure 2:
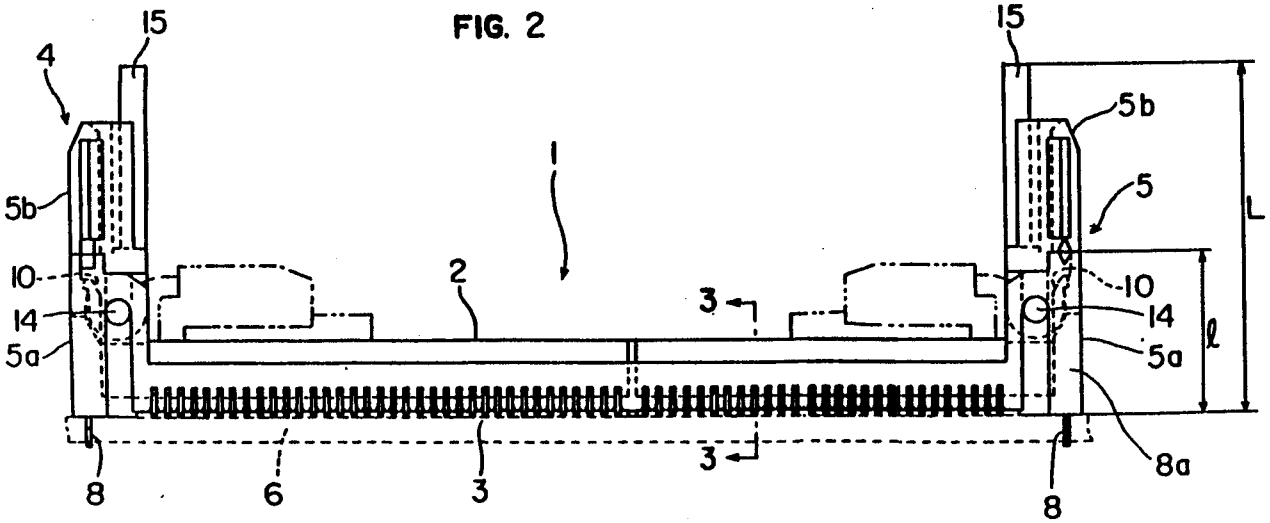
Figure 3:
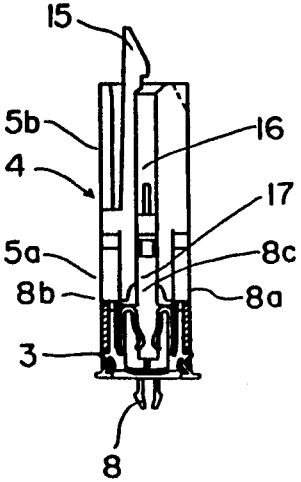
Figure 6:
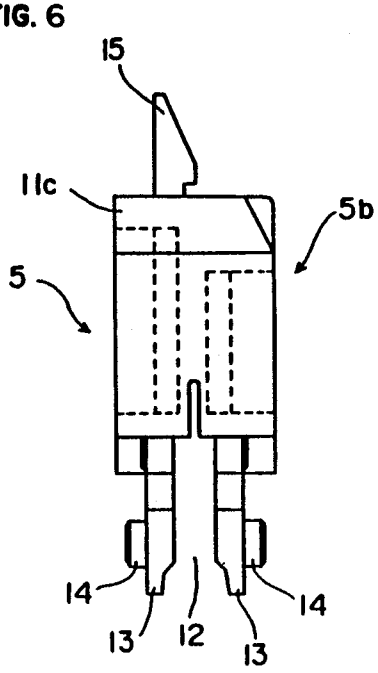
Figure 5:
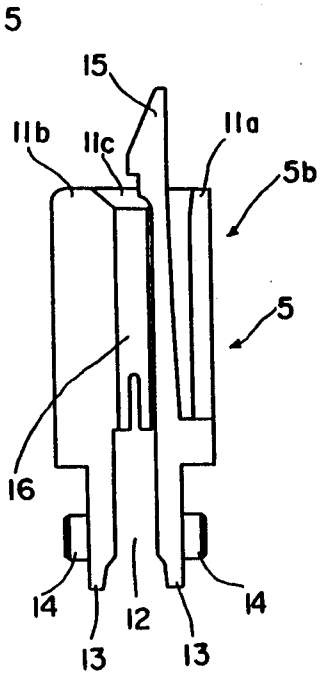
Figure 7:
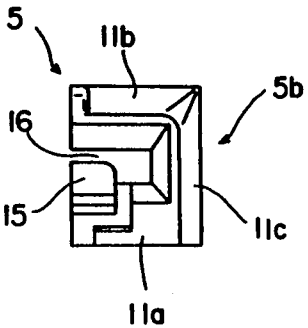

The guide posts 4 and 5 are adapted to accommodate and hold a printed board 7. Opposite guide posts 4 and 5 are the same in structure, and therefore only right guide post 5 shown in FIG. 2 is described below.

Figure 4:
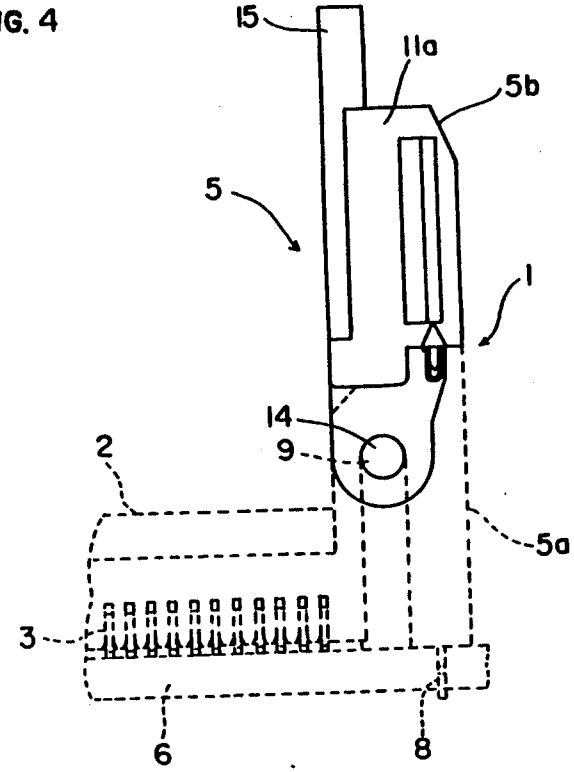

FIG. 4 is an enlarged view of right guide post 5. It has two separate sections, that is, upper and lower section 5*b* and 5*a*. Lower section 5*a* is integrally connected to the right side of connector housing 2. Particularly, lower section 5*a* and connector housing 2 are integrally molded. Lower section 5*a* has a "U"-shaped cross section having front, rear and side walls 8*a*, 8*b* and 8*c* respectively. An axle hole 9 is made near the tops of front and rear walls 8*a* and 8*b* as indicated by broken line in FIG. 4. A longitudinal positioning projection 10 is provided on the middle of the wall 8*c* as indicated by broken line in FIG. 2.

The upper section 5*b* has a "U" shaped cross section includes front, rear and side walls 11*a*, 11*b* and 11*c*. Front and rear walls 11*a* and 11*b* have leg extensions 13, with a longitudinal space 12 therebetween. Each leg has an axle projection 14 which fit in axle hole 9 in front and rear walls 8*a* and 8*b* of the lower section 5*a*.

The width of longitudinal space 12 between opposite leg extensions 13 of front and rear walls 11*a* and 11*b* is selected to accommodate longitudinal positioning projection 10 of side wall 8*c* of lower section 5*a*. The bottom of the upper section 5*b* from which leg extensions 13 extend, abut against the top of the lower section 5*a*. A latch 15 is integrally connected to upper section 5*a* of guide post 5. Latch 15 may spring back to its initial position when an exterior force is removed.

A guide slot 16 in the upper section 5*b* of guide post 5 is placed in alignment with a guide slot 17 of lower section 5*a* of the guide post 5 when the upper section 5*b* is positioned upright upon the lower section 5*a*.

In use, electrical connector 1 is attached to the printed board 6, and the upper section 5*b* is rotated and stands upright on the lower section 5*a*. The opposite edges of the printed board 7 are then inserted in guide slots 16 and 17 of opposite guide posts 4 and 5 respectively, until board 7 is engaged by the latches 15.

Before the automated soldering procedure, the electrical connector 1 is first attached to board 6, terminals 3 of the electrical connector 1 are located on selected conductors on printed circuit board 6 and solder is applied to these terminals and conductors. Pegs 8 hold the connector 1 in place. Then, the upper sections 5*b* of opposite guide posts 4 and 5 are rotated 90 degrees with respect to lower sections 5*a* as indicated by two dot and dash lines in FIG. 2, and the connector and printed board combination is brought to the inlet of an automated soldering apparatus (not shown) by an associated conveyor belt (not shown).

When upper sections 5*b* of opposite guide posts 4 and 5 are rotated to stand upright on lower sections 5*a*, the total height of the upper and lower sections of each guide post 4 or 5 will be as indicated by "L" in FIG. 2, and will be of sufficient height to permit electrical connector to firmly hold the printed circuit board 7. When the upper sections 5*b* are rotated to their lowest position on printed board 6, the total height will be as indicated by "1" in FIG. 2, and will be sufficiently low to allow the electrical connector and printed board combination to enter the inlet of the automated soldering apparatus.

Referring to FIGS. 8 to 12, there is shown an electrical connector according to a second embodiment of the present invention. The following description is directed to the right guide post 5, omitting description of the general structure of electrical connector and left guide post 4, which is the same as the right guide post.

Figure 10:
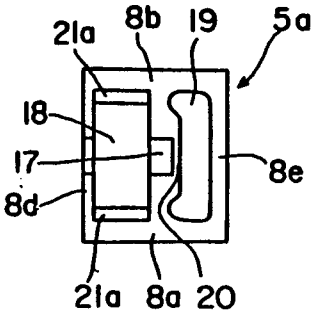
Figure 11:
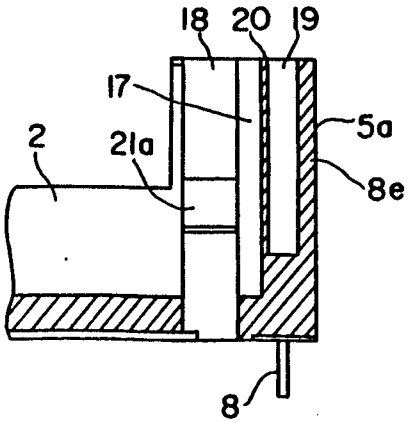

FIG. 10 is a top view of lower section 5*a* of the right guide post 5, wherein the lower section 5*a* is integrally connected to one side of electrical connector housing 2. Lower section 5*a* has a "U" shaped cross section, and includes front, rear and left and right side walls 8*a*, 8*b* and 8*d* and 8*e*. These four walls encircle and delineate a leg insertion space 18. Further delineated by left side wall 8*d* and a boundary 20, and by right side wall 8*e* is a leg insertion space 19. Spaces 18 and 19 extend longitudinally parallel to each other. Front and rear walls 8*a* and 8*b* have first latch projections 21*a* located substantially at their mid section.

Figure 9:
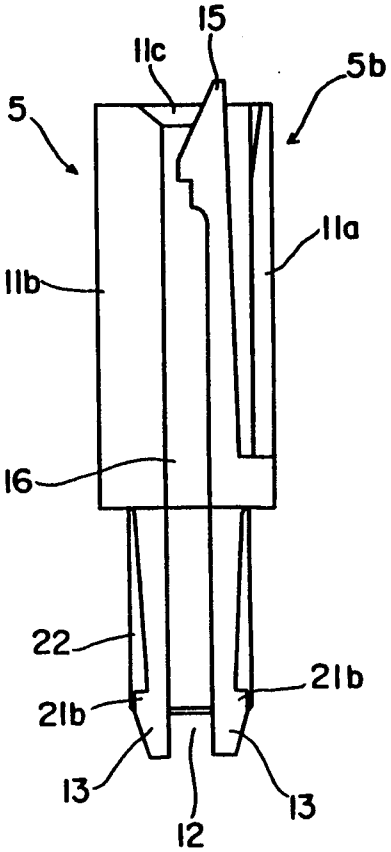
FIGS. 8 to 12 show a board to board electrical connector according to a second embodiment of the present invention.

The upper section 5*b* of guide post 5 has a "U" shaped cross section, and is composed of front, rear and side walls 11*a*, 11*b* and 11*c*. As shown in FIG. 9 front and rear walls 11*a* and 11*b* have leg extensions 13, leaving longitudinal space 12 therebetween. Side wall 11*c* has attachment extension 22 integrally connected to the lower part of side wall 11*c* and extending parallel to leg extensions 13 of front and rear wall 11*a* and 11*b*. Each leg has a second counter latch projection 21*b* to mate with first latch projection 21*a* of front or rear wall 11*a* or 11*b*. Boundary 20 of lower section 5*a* of guide post 5 fits in the space left between leg extension 13 and attachment extension 22.

Latch 15 is integrally connected to upper section 5*b* of guide post 5. Latch 15 springs back to its initial position when an exterior force is removed. Guide slot 16 of upper section 5*b* of guide post 5 is put in alignment with guide slot 17 of lower section 5*a* of guide post 5 when upper section 5*b* is mated with lower section 5*a*.

In use electrical connector 1 is attached to the printed board 6, and the upper section 5*b* is mated with lower section 5*a*. The opposite edges of the printed board 7 are then inserted in guide slots 16 and 17 of opposite guide posts 4 and 5 until printed board 7 is caught by latches 15. More specifically, in mating upper section 5*b* with lower section 5*a* of guide post 5, leg extensions 13 of upper section 5*b* are inserted in leg insertion space 18 until second lock projections 21*b* of leg extensions 13 are engaged by first lock projections 21*a* of front and rear walls 8*a* and 8*b*. At the same time attachment extension 22 of upper section 5*b* is inserted and closely fitted in attachment insertion space 19 of lower section 5*a*.

Before the automated soldering procedure, when the electrical connector is first attached to printed board 6 with upper section 5*b* removed from lower section 5*a* of each guide post 5, terminals 3 of electrical connector are located on selected conductors of printed board 6 and solder is applied to these terminals and conductors. Pegs 8 hold the connector 4 in place. Then, the connector and printed board combination is moved to the inlet of the automated soldering apparatus by an associated conveyor belt conveyor (not shown).

Figure 8:
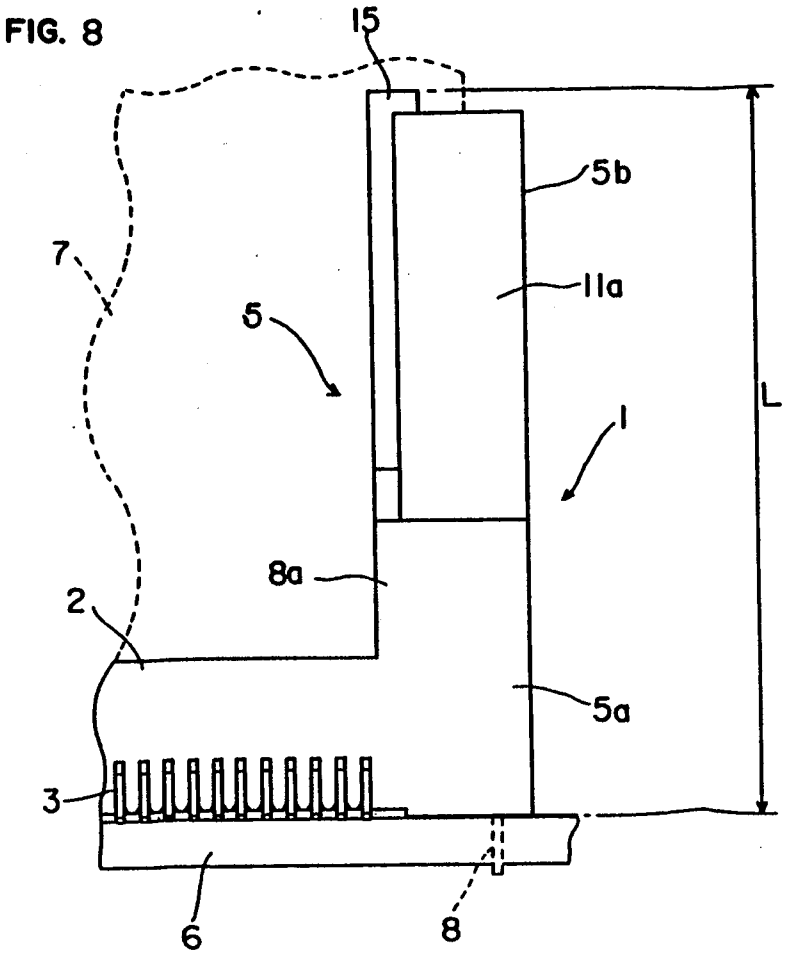
Figure 12:
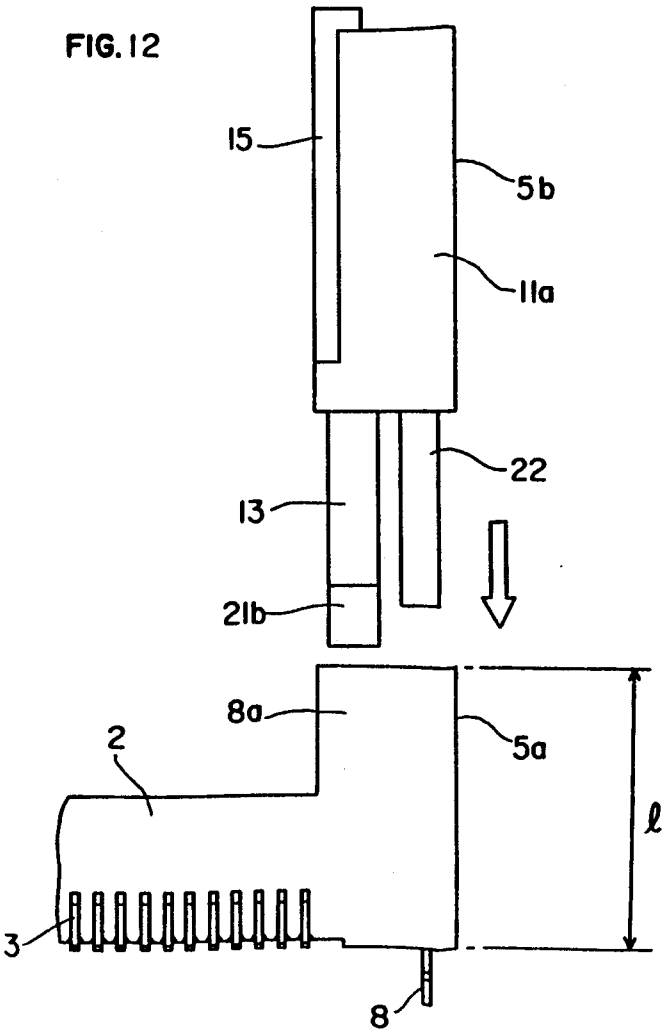

When upper section 5b of opposite guide posts 4 and 5 are mated with lower section 5a, the total height of the upper and lower section of each guide post 4 or 5 is indicated by "L" in FIG. 8, and will be high enough to permit electric connector 1 to firmly hold the printed circuit board 7. On the other hand, when upper sections 5b are removed from lower sections 5a, the total height will be as indicated by "1" in FIG. 12, and will be low enough to allow the electric connector and printed board combination to enter the inlet of the automated soldering apparatus.

As may be understood from the above, a board-to-board electrical connector according to the present invention permits: first, its opposite guide posts to reduce their height so that the electrical connector may fit in the inlet of an automated soldering apparatus for soldering its terminals to selected conductors of a printed board; and second, its opposite guide posts to extend their height so that the electrical connector may accommodate and hold another printed board for board-to-board connection. The height adjustment of opposite guide posts may be effected by rotating their upper sections about their pivots to either stand erect or lie flat or by coupling or decoupling their upper and lower sections.

What is claimed is:

1. A surface mountable electrical connector adapted for mounting on the surface of a printed circuit board, said circuit board having contact elements on the surface thereof, comprising, a connector housing having a plurality of terminals arranged at regular intervals for electrically and mechanically securing to contact elements on the surface of the printed circuit board, the terminals defining a slot to receive an edge of a printed circuit card, the housing having insulative guide posts positioned at opposite ends of the housing adjacent said slot, each post adapted to receive a side of the printed circuit card inserted into the slot, each post further including a lower section integrally formed with said housing and an upper section pivotally mounted on said lower section, and said upper section of each guide post being movable between a first operative position at which said connector is configured to receive and retain said printed circuit card and a second inoperative position at which said connector is unable to retain said printed circuit card during a portion of the process of mechanically and electrically mounting said connector to said printed circuit board.

2. An electrical connector in accordance with claim 1, wherein the upper section of each post is releasably mounted upon the upper section.

3. A method of securing an edge card connector to the surface of a circuit board, comprising the steps of:

providing a circuit board having a plurality of electrical traces connected to contact elements positioned on the surface of said circuit board;

providing an edge card connector for receiving an edge card therein, said connector having an insulative housing including an opening for accommodating an edge of said edge card and a plurality of electrically conductive terminals positioned along said opening and having tail portions extending from said housing, said housing further including a pair of guide posts located at opposite ends of said opening, each guide post having means for accommodating a side of said edge card and being divided into an upper section and a lower section, said upper section of each guide post being pivotally mounted on said lower section;

applying a solder compound to the surface of said contact elements;

positioning said connector on a surface of said circuit board and aligning said tail portions with respective ones of said contact elements of said circuit board;

pivoting said upper section to a first position adjacent said housing opening to reduce the distance between the circuit board and the portion of the connector furthest from said circuit board to reduce the overall height of said connector;

processing said circuit board having said connector thereon through an automated surface mount soldering mechanism having an inlet opening of a certain predetermined height to solder said tails to their respective contact elements, said height of said inlet opening being greater than said overall height of said connector; and rotating said upper section of said guide post to a second position at which said guide post is configured to receive said edge card.

* * * * *